US009085860B2

(12) United States Patent
Dubiel

(10) Patent No.: US 9,085,860 B2
(45) Date of Patent: Jul. 21, 2015

(54) WING PLOW POST

(71) Applicant: Universal Truck Equipment, Inc., Galesville, WI (US)

(72) Inventor: Eugene J. Dubiel, Galesville, WI (US)

(73) Assignee: Universal Truck Equipment, Inc., Galesville, WI (US)

( * ) Notice: Subject to any disclaimer, the term of this patent is extended or adjusted under 35 U.S.C. 154(b) by 123 days.

(21) Appl. No.: 14/017,947

(22) Filed: Sep. 4, 2013

(65) Prior Publication Data

US 2014/0068975 A1 Mar. 13, 2014

Related U.S. Application Data

(60) Provisional application No. 61/696,425, filed on Sep. 4, 2012.

(51) Int. Cl.
*E01H 5/06* (2006.01)

(52) U.S. Cl.
CPC ..... *E01H 5/067* (2013.01)

(58) Field of Classification Search
CPC ..... E01H 5/067; A01D 34/661; E02F 3/7627
USPC ..... 37/234; 172/99, 819, 811, 821, 822, 172/824
See application file for complete search history.

(56) References Cited

U.S. PATENT DOCUMENTS

| | | | |
|---|---|---|---|
| 1,645,837 | A | 10/1927 | Wadsworth |
| 1,853,939 | A | 4/1932 | Soule et al. |
| 1,956,007 | A | 4/1934 | Davin et al. |
| 2,565,337 | A | 8/1951 | Allan |
| 2,682,822 | A | 7/1954 | Toland et al. |
| 2,874,656 | A | 3/1957 | Sheppard |
| 2,991,566 | A | 7/1961 | Sumner et al. |
| 3,204,352 | A | 9/1965 | Hughes |
| 3,483,643 | A | 12/1969 | Wenzel |
| 3,587,182 | A | 6/1971 | Hirt |

(Continued)

FOREIGN PATENT DOCUMENTS

| | | |
|---|---|---|
| CA | 2 748 223 | 2/2012 |
| EP | 0 467 310 B1 | 6/1994 |

(Continued)

OTHER PUBLICATIONS

J. Reimpell et al., "The Automotive Chassis", 1986, 3 pages.

(Continued)

*Primary Examiner* — Robert Pezzuto
*Assistant Examiner* — Jessica H Lutz
(74) *Attorney, Agent, or Firm* — Patterson Thuente Pedersen, P.A.

(57) ABSTRACT

A wing plow post and method of manufacturing the post is disclosed. The post is intended for attaching a wing plow to vehicle for moving material, such as snow. The links of the post are parallel to the angle of the wing plow when the plow is in the plowing position to minimize stress on the post and frame of the vehicle. The post includes a float collar on the hydraulic lift cylinder to provide free floating of the toe end of the wing plow. It allows a wing plow to move over road surfaces and limit the stress on both the post itself and the frame of the vehicle to which the post is attached. Further, the present invention also allows power to be provided by a hydraulic cylinder in the downward direction to the toe end of the wing plow.

11 Claims, 14 Drawing Sheets

(56) References Cited

U.S. PATENT DOCUMENTS

| | | | |
|---|---|---|---|
| 3,587,751 | A | 6/1971 | Schmidt, Jr. |
| 3,588,147 | A | 6/1971 | Enters |
| 3,659,363 | A | 5/1972 | Snyder |
| 3,664,057 | A | 5/1972 | Dunn |
| 3,715,872 | A | 2/1973 | Thompson, Jr. |
| 3,720,010 | A | 3/1973 | Coates |
| 4,029,338 | A | 6/1977 | Headley |
| 4,045,892 | A | 9/1977 | Farrell |
| 4,096,652 | A | 6/1978 | Raines et al. |
| 4,183,195 | A | 1/1980 | James |
| 4,320,589 | A | 3/1982 | Pelazza |
| 4,357,766 | A | 11/1982 | Croteau et al. |
| 4,479,312 | A | 10/1984 | Turgeon |
| 4,495,754 | A | 1/1985 | Cartner |
| 4,565,018 | A | 1/1986 | Oya |
| 4,570,367 | A | 2/1986 | Oya |
| 4,596,081 | A | 6/1986 | DeBilly et al. |
| 4,744,159 | A | 5/1988 | Houle |
| 4,969,280 | A | 11/1990 | Thorneloe |
| 5,031,343 | A | 7/1991 | Houle et al. |
| 5,148,617 | A | 9/1992 | Feller et al. |
| 5,177,887 | A | 1/1993 | McGugan et al. |
| 5,809,672 | A | 9/1998 | Jones |
| 5,819,444 | A | 10/1998 | Desmarais |
| 6,249,992 | B1 | 6/2001 | Irving et al. |
| 6,408,547 | B1 | 6/2002 | Jones et al. |
| 6,412,200 | B1 | 7/2002 | Savard |
| 6,442,877 | B1 | 9/2002 | Quenzi et al. |
| 6,526,677 | B1 | 3/2003 | Bloxdorf et al. |
| 6,581,307 | B1 | 6/2003 | Jones et al. |
| 6,871,425 | B2 | 3/2005 | Feller |
| 6,922,924 | B2 | 8/2005 | Jones et al. |
| 6,941,686 | B2 | 9/2005 | Cusick |
| 7,107,710 | B2 | 9/2006 | Savard |
| 7,523,569 | B2 | 4/2009 | Savard |
| 7,918,042 | B2 | 4/2011 | Ropog |
| 7,954,262 | B2 | 6/2011 | Bernier |
| 8,596,376 | B2 | 12/2013 | Holverson et al. |
| 8,732,988 | B2 | 5/2014 | Hanson |
| 2003/0066210 | A1 | 4/2003 | Hollinrake et al. |
| 2005/0204587 | A1 | 9/2005 | Kime |
| 2007/0271828 | A1 | 11/2007 | Mishra et al. |
| 2012/0024551 | A1 | 2/2012 | Holverson et al. |
| 2012/0285050 | A1 | 11/2012 | Osgood |
| 2012/0311893 | A1 | 12/2012 | Knott et al. |
| 2013/0160333 | A1 | 6/2013 | Becicka et al. |
| 2013/0227863 | A1 | 9/2013 | Stephan |
| 2014/0250738 | A1 | 9/2014 | Osgood |
| 2014/0326472 | A1 | 11/2014 | Holverson et al. |

FOREIGN PATENT DOCUMENTS

| | | |
|---|---|---|
| FI | 75625 | 3/1988 |
| GB | 2 172 037 A | 9/1986 |
| SE | 466 317 | 1/1992 |

OTHER PUBLICATIONS

Staniforth, "Competition Car Suspension", 1999, 5 pages.
Henderson, "Smart Link Rotational Floating Wing Mast" Brochure, Dec. 2012, 2 pages.
Lannert, "Snowplow Operations and Equipment Plowing Wider and Faster on 21g-Century Highways by Using 14-ft Front Plows and Trailer Plows Effectively", pp. 261-266.
Martikainen et al., "Maintenance Technology Exchange Partnership: Minnesota Department of Transportation/Finnish National Road Administration", Iowa State University Institute for Transportation, Apr. 10, 2015, 7 pages.
Amended Complaint dated Jul. 7, 2014.
Answer to Amended Complaint & Amended Counterclaims dated Jul. 21, 2014.
Answer to Amended Counterclaims dated Aug. 4, 2014.
Supplemental Infringement Contentions dated Jul. 18, 2014.
Supplemental Invalidity Contentions dated Sep. 4, 2014.
Fed. R. Civ. P. 26(a)(2)(C) Expert Disclosure of Gene Dubiel dated Nov. 3, 2014.
Expert Report of Dr. Glenn R. Bower Regarding Infringement of U.S. Pat. No. 8,596,376 dated Nov. 14, 2014.
Defendant Universal Truck, Inc.'s Memorandum of Law in Support of its Motion for Summary Judgment dated Nov. 26, 2014.
Plaintiffs' Rule 26(a)(2)(C) Disclosure of Andrew Holverson dated Dec. 4, 2014.
Expert Report of Dr. Glenn R. Bower Regarding Validity of U.S. Pat. No. 8,596,376 dated Dec. 12, 2014.
Plaintiff's Brief in Opposition to Defendant's Motion for Summary Judgment dated Dec. 17, 2014.
Plaintiffs' Rule 26(a)(2)(C) Disclosure of Andrew Holverson Regarding Validity dated Dec. 17, 2014.
Fed. R. Civ. P. 26(a)(2)(C) Expert Disclosure of Ryan R. Hulett in Rebuttal to Expert Report of Dr. Glenn R. Bower dated Dec. 26, 2014.
Defendant Universal Truck, Inc.'s Reply Memorandum of Law in Support of its Motion for Summary Judgment dated Dec. 29, 2014.
Letter from Snyder to Biasco dated Apr. 8, 2015.
Letter from Snyder to Biasco dated May 8, 2015.

WING PLOW POST

FIELD OF THE INVENTION

The present invention relates to a support for attaching a wing plow to a vehicle used for a wing plow application such as a truck, loader, or grader. Wing plows are typically used for removing snow from pavement and road shoulders. They can also be used for leveling materials during road construction, repair, or construction. The wing plow extends laterally from the side of a vehicle and includes a brace or braces for supporting the outboard end, also referred to as the heel, of the wing plow. Most supports use plates fastened to the vehicle frame, typically with bolts and nuts. Attached to the plates, a tube extends laterally towards the wing plow. Such support arrangements attach the heel of the wing plow to a push beam, typically with a spring mechanism to absorb shock from the wing plow contacting the roadway. A hydraulic cylinder is commonly used to raise the heel of the wing plow.

BACKGROUND OF THE INVENTION

Numerous configurations have been used for supporting the inboard end, also referred to as the toe, of the wing plow. This portion of the wing plow undergoes extreme stress and wear while in operation. Most supports use plates fastened to the vehicle frame, typically with bolts and nuts. Attached to the plates, a tube extends laterally towards the toe of the wing plow. Various methods of bracing these arrangements are also implemented. Such support arrangements usually include a means for raising or lowering the wing plow because when the wing plow is not being used, the wing plow should be in a raised position when the vehicle is moving to eliminate contact with the ground and avoid damage to the wing plow, support, or vehicle. These configurations are also subject to substantial wear and fatigue at the toe of the wing plow due to stresses caused by their inability to raise and lower over rough terrain. Most support arrangements have a very limited ability to float over these surfaces. Some wing plow supports use various styles of links or armatures extending laterally outwards from the front side of a vehicle to the toe of the wing plow. This allows the wing plow to rise and fall as it moves with the material being moved and with the lower edge of the wing plow remaining substantially parallel to the surface of the material and provide optimal plowing.

U.S. Patent Publication US2012/0024551 discloses one potential solution to the above mentioned problem by providing a trailing link mechanism such that the toe of the wing plow is supported by a support arm which in turn is supported by trailing links rather than the prior art laterally extending links or armature.

Yet, U.S. Patent Publication US2012/0024551 still has several drawbacks, including lateral stress on the links perpendicular to the vehicle. U.S. Patent Publication US2012/0024551 is also configured so that lateral stress will cause the trailing links to rub against its plates, causing wear on the links. U.S. Patent Publication US2012/0024551 also cannot provide downward pressure from the hydraulic cylinder to the lifting mechanism, and is unable to free the links in the event of the plow remaining in the upright carrying position when the operator wants to engage it. The operator has to manually force it down by hand.

U.S. Pat. No. 6,581,307 extends out perpendicular to the truck and uses a hydraulic lift cylinder that is fixed to the linkage on both ends. The armature of this design is also wider at the base end and narrower at the plow pivot end forming an A-frame. U.S. Pat. No. 6,581,307 mounts the wing plow on a vertical wing positioning bar. Further, U.S. Pat. No. 6,581,307 uses elastic bushings in the wing plow pivot points.

U.S. Pat. No. 6,581,307 by extending perpendicular to the vehicle, the lateral stress will be greater putting more pressure and wear on the pivot points of the linkage. Furthermore, by fixing the hydraulic lift cylinder to the linkage at both ends, it uses a vertical wing positioning bar for the wing to float on. In the case of the wing plow needing more float, the hydraulic cylinder may include a one-way valve. The armatures typically remain in a fixed position while plowing.

U.S. Patent Publication US2013/0160333 uses a rotating mount located on plates parallel to the vehicle. The rotating mount trails the vehicle and does not extend laterally. U.S. Patent Publication US2013/0160333 configuration causes the wing plow to trip forward when striking an immobile object. U.S. Patent Publication US2013/0160333 has a hydraulic lift cylinder that is directly connected to the trailing lift arm. It uses a chain or slotted cam to create the float for the wing plow.

U.S. Patent Publication US2013/0160333 rotating mount trails the vehicle and does not extend laterally. Furthermore, U.S. Patent Publication US2013/0160333 uses a rotating mount that trips over every obstacle, causing the plow wing to remain in the tripped position thus, affecting the function of the wing plow. U.S. Patent Publication US2013/0160333 uses a substantially different method to create the wing plow float that puts a great amount of stress on one connection point.

SUMMARY OF THE INVENTION

The inventor of the present invention has found that arrangement of the links of the post to be parallel to the angle of the wing plow when in the plowing position minimizes the stress at the toe end of the wing plow and results in the smoothest flow and operation. Therefore, the primary feature of the present invention is to provide a wing plow support apparatus that minimizes the stress at the toe end of a wing plow by arranging links in a substantially parallel alignment with the wing plow when the wing plow is in the plowing position.

Another feature of the present invention is to provide a wing plow support that has built in float to allow the plow to move with variations in the ground or material being moved. Further, the present invention allows power to be provided by a hydraulic cylinder in the downward direction of the toe end of the wing plow. Other features of the present invention include a bushing system compromising of one bushing in each side plate and one bushing in the connection arm for each link pivot axis with the ability to provide grease for each link axis as well as extension of side plates to prevent unnecessary wear on the links. The present invention also provides locking collars to secure the pivot bolts. Further, the extended side plates also cover the lift pin connected to the hydraulic cylinder and prevent it from falling out during operation. The configuration of the extended side plates also protects the hydraulic cylinder by limiting the travel of the front vertical plate. Another feature of the present invention is to provide access to the internal parts without having to take the wing plot support apart.

DETAILED DESCRIPTION OF THE DRAWINGS

Figure 1:
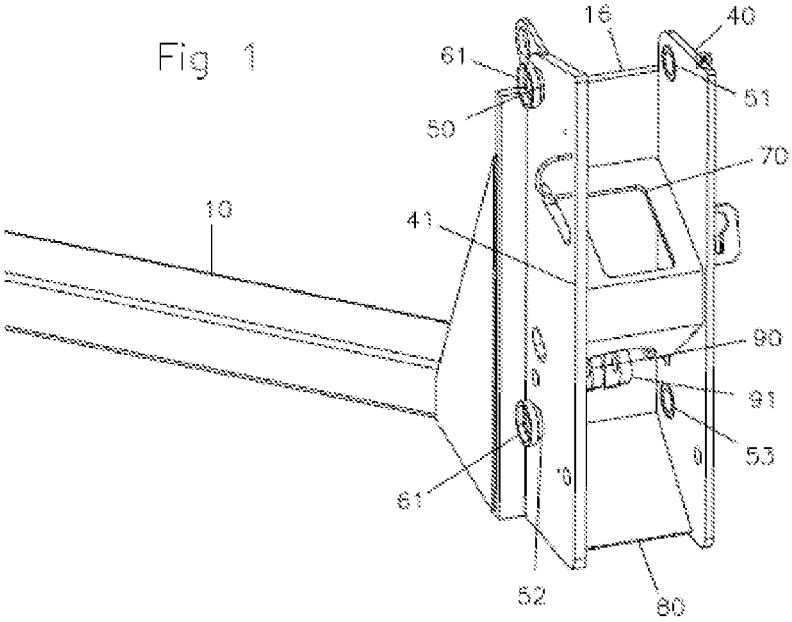
FIGS. 1-3 show an embodiment of the mounting assembly of the present invention.
Figure 2:
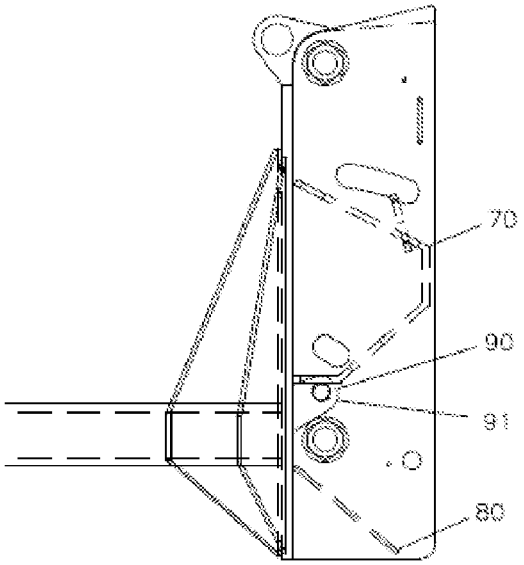
Figure 3:
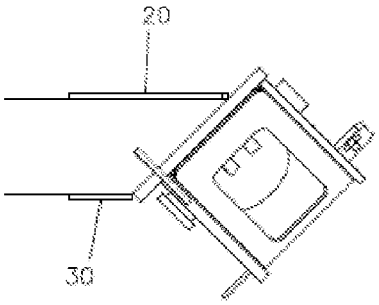
Figure 13:
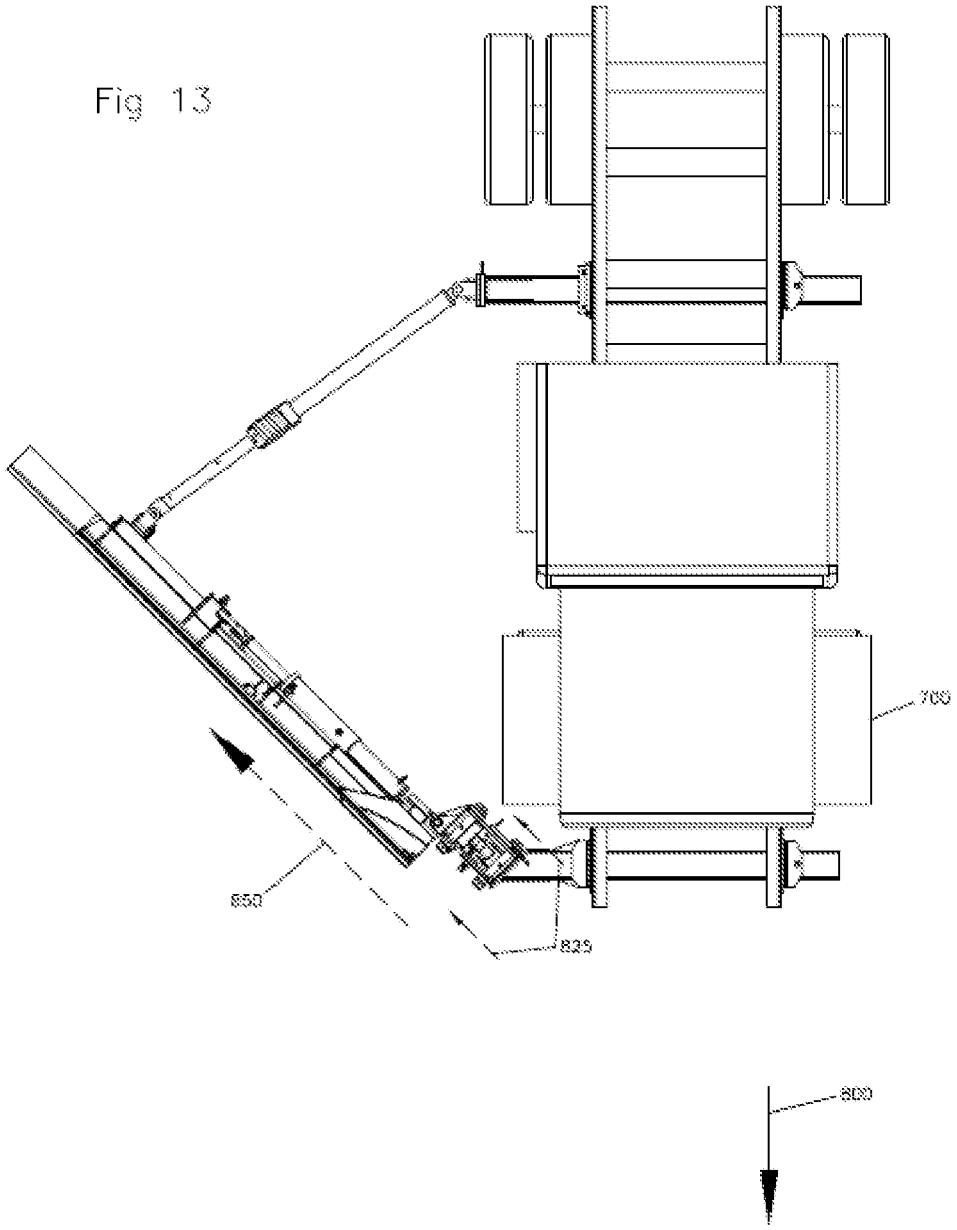
FIG. 13 shows an embodiment of a wing plow post of the present invention parallel to the wing plow in its operating position.
Figure 18:
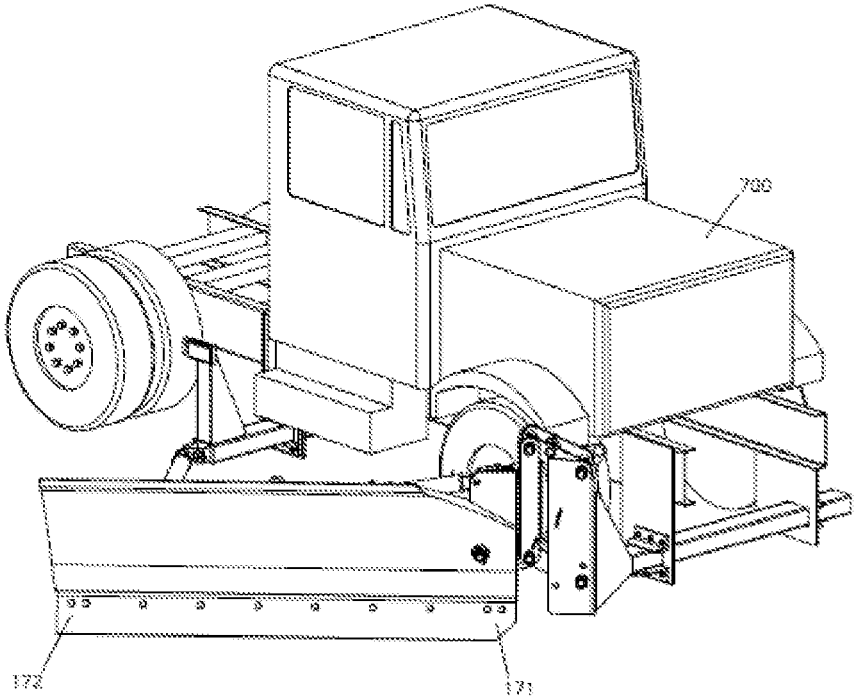
FIG. 18 shows a wing plow post attached to a vehicle with a wing plow of an embodiment of the present invention.

One embodiment of the present invention is a mechanism that allows a wing plow to be attached to the frame of a vehicle 700 [FIGS. 13 and 18], typically a large truck, for the movement of material, usually snow. A preferred embodiment of the invention utilizes welding to attach several of the components but is not necessarily so limited; other methods of connecting components include glue, fasteners, pins, and other methods of attachment not mentioned. Further, several components can be molded in a single unibody constructions. The embodiment [FIG. 1] consists of a tube 10 connected to the vehicle 700. Various mounting practices have been utilized to connect wing post tubes to a vehicle 700. The tube 10 extends outwards toward the direction of the toe end of the wing plow. A vertical plate 16 is secured to the end of the tube 10 and braced [FIG. 3] by a front plate 20 and rear plate 30. Extending out laterally side plates 40, 41 are fixed to the vertical plate 16 and align the post assembly with the wing plow when it is in its operating position. The side plates 40, 41 hold bushings 50, 51, 52, and 53 for two link arm pivot points. Located on bushings 50, 52 are bolt head collars 60, 61. The side plates 40, 41 are also affixed by two internal braces 70, 80. The middle brace 70 is configured in such away to allow access to the hydraulic cylinder. The lower brace 80 is angled downward to allow snow and debris to fall out of the assembly. Also mounted on the vertical plate 16 and tube 10 [FIG. 2] are the hydraulic cylinder connection ears 90, 91.

Figure 4:
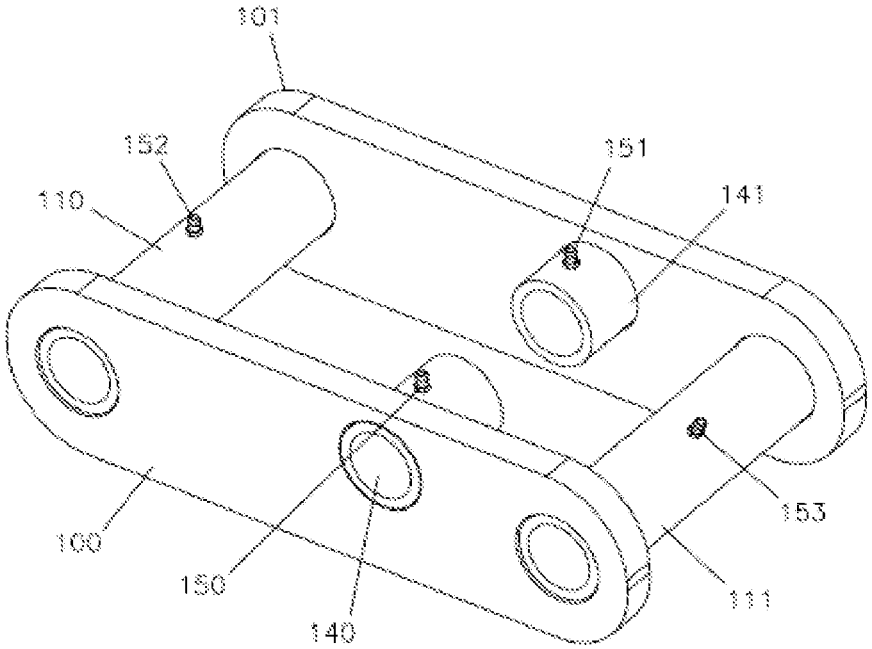
FIG. 4 shows an upper connection link arm of an embodiment of the present invention.

The upper connection arm [FIG. 4] consisting of two side links 100, 101 that are secured by bushings 110, 111. Located in bushing 110, 111 are grease fittings 152, 153. Additionally, cylinder pin bushings 140, 141 are in side links. Located in each of these cylinder pin bushings 140, 141 are grease fittings 150, 151.

Figure 5:
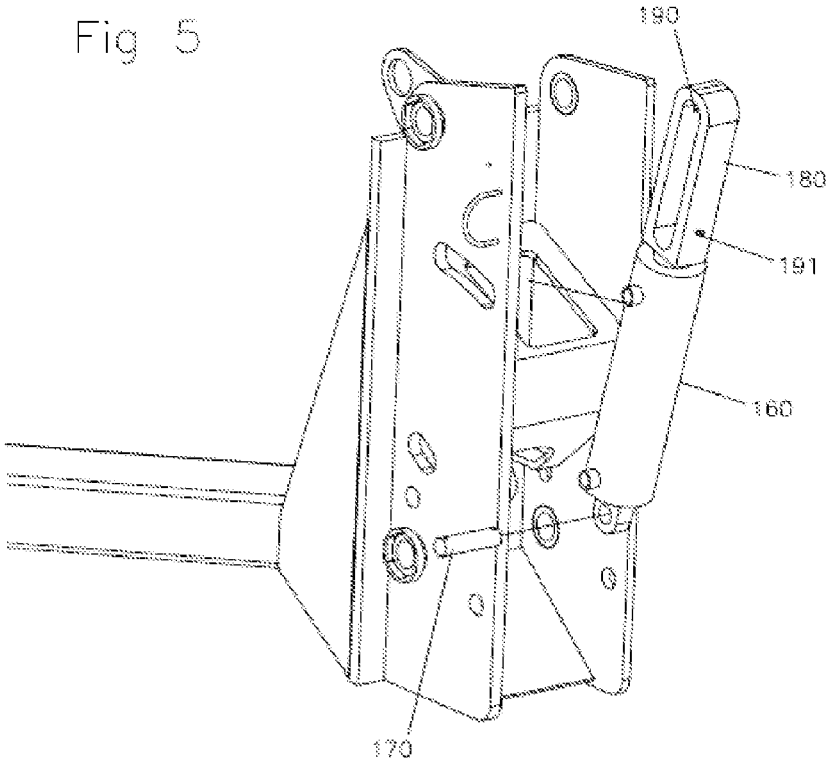
FIG. 5 shows a hydraulic cylinder mounting of an embodiment of the present invention.
Figure 6:
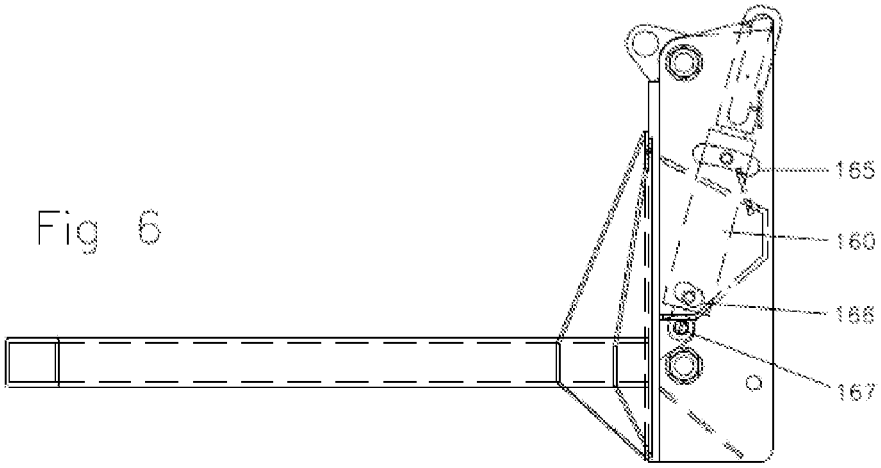
FIG. 6 shows the side view of the post assembly and the access holes for the hydraulic hoses and the connection pin of an embodiment of the present invention.
Figure 7:
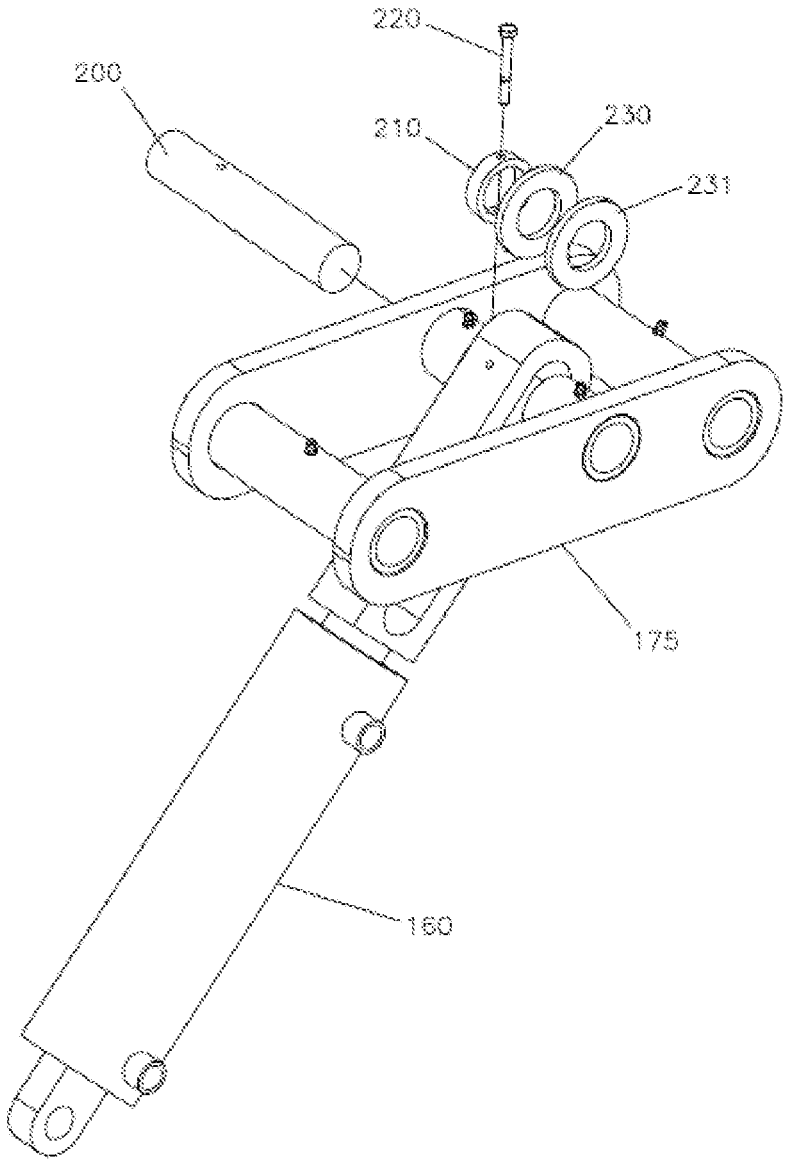
FIG. 7 shows an upper connection link arm mounting to the hydraulic cylinder of an embodiment of the present invention.

A hydraulic cylinder 160 [FIG. 5] is mounted to the post assembly by a pin 170. Attached to the live end of the hydraulic cylinder 160 is a float collar 180. Further grease fittings 190 and 191 are mounted in the float collar 180. As shown in [FIG. 6] the side view of assembly with the hydraulic cylinder 160 mounted in position. The extended side plate has cutouts 165 and 166 to allow the hydraulic hoses to move with the hydraulic cylinder 160 during operation. Also shown, is the bottom hole 167 to access the lower connection point of the hydraulic cylinder 160. This hole allows for easier maintenance to remove connection pin. The hydraulic cylinder 160 connects to the upper arm 175 [FIG. 7] by pin 200. Collar 210 secures the pin in the assembly with bolt 220. Spacers 230, 231 mount on the pin between the connection arm sides and prevent lateral movement by the cylinder.

Figure 8:
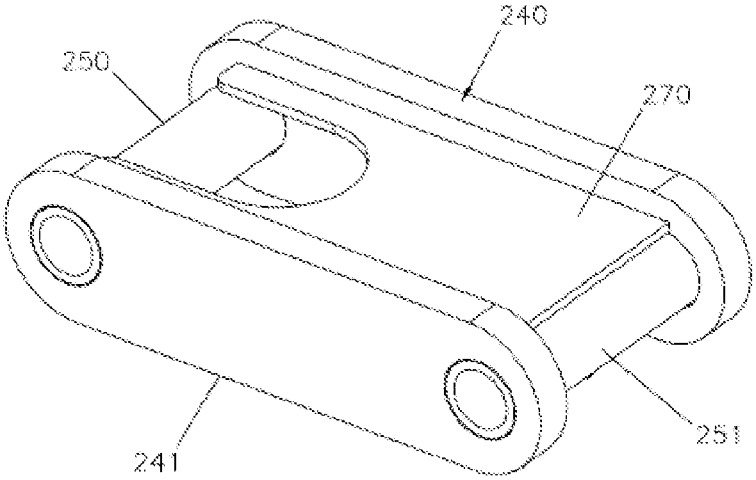
FIGS. 8-9 show a lower connection link arm of an embodiment of the present invention.
Figure 9:
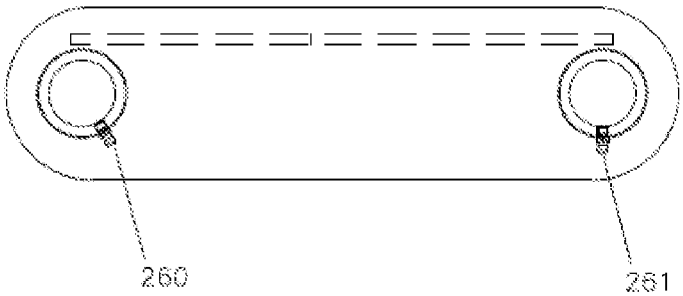

The lower connection arm [FIG. 8] consisting of two side links 240, 241 that are rigidly supported by bushings 250, 251. Located in each bushing [FIG. 9] are grease fittings 260 and 261. Further bracing is provided by brace 270 affixed to the side links 240, 241 and bushings 250, 251.

Figure 10:
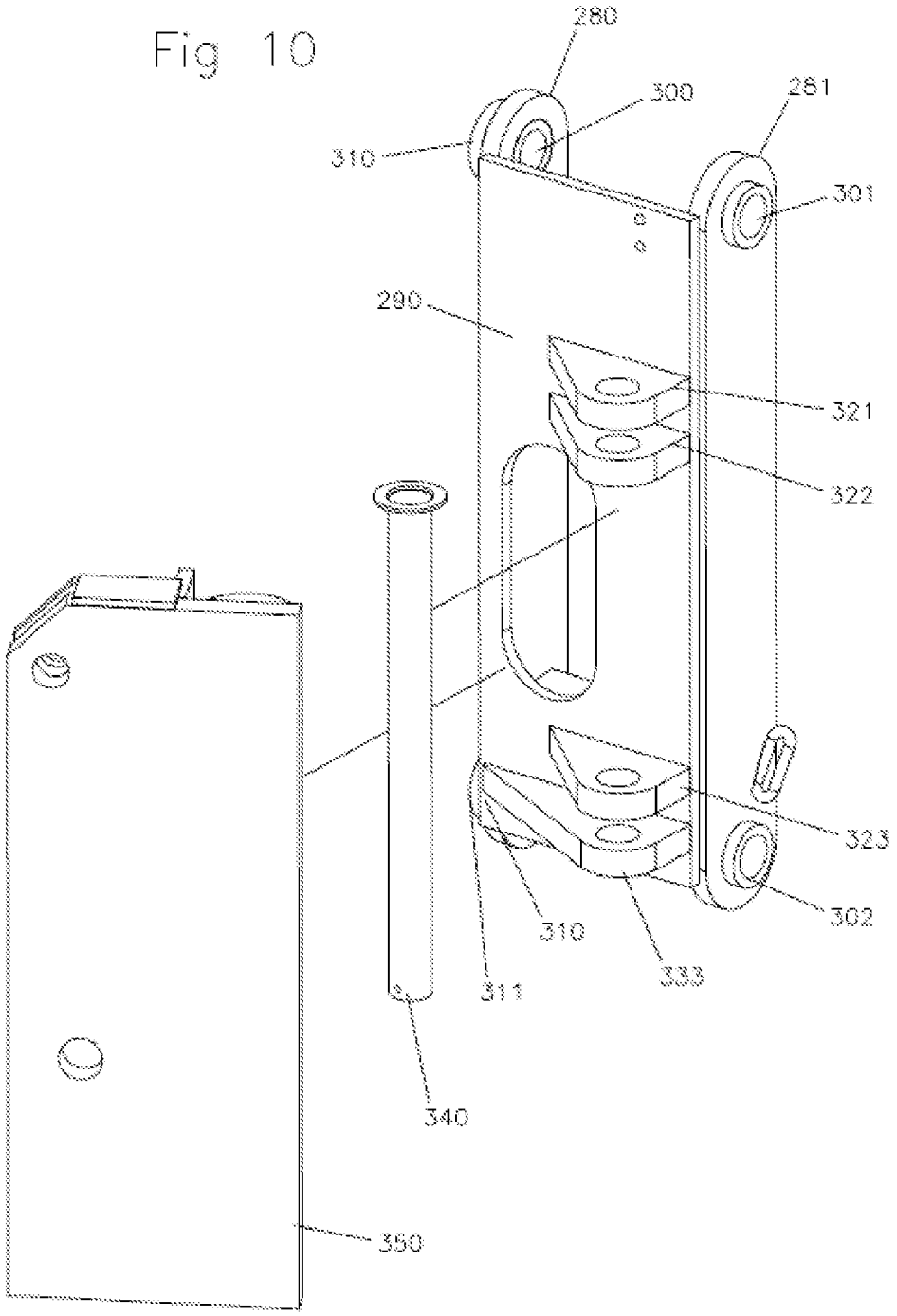
FIG. 10 shows a front vertical plate assembly and a wing plow slab of an embodiment of the present invention.

A front vertical plate assembly [FIG. 10] is mounted off of the upper connection arm and the lower connection arm. Two vertical links 280, 281 are fixed about a front plate 290. The front plate 290 includes a cutout to access the hydraulic lift cylinder for maintenance. Additionally, in the vertical links are bushings 300, 301, 302, and 303. Bolt collars 310, 311 are mounted on bushings 300, 303. Located off of the front plate 290 are three mounting ears 321, 322, and 323 and one bottom mounting ear 333. Slab pin 340 attaches a standard wing plow slab 350 to ears 321, 322, 323, and 333. Wing plow slabs 350 are standard equipment and numerous versions similar in art have been used over the years.

Figure 11:
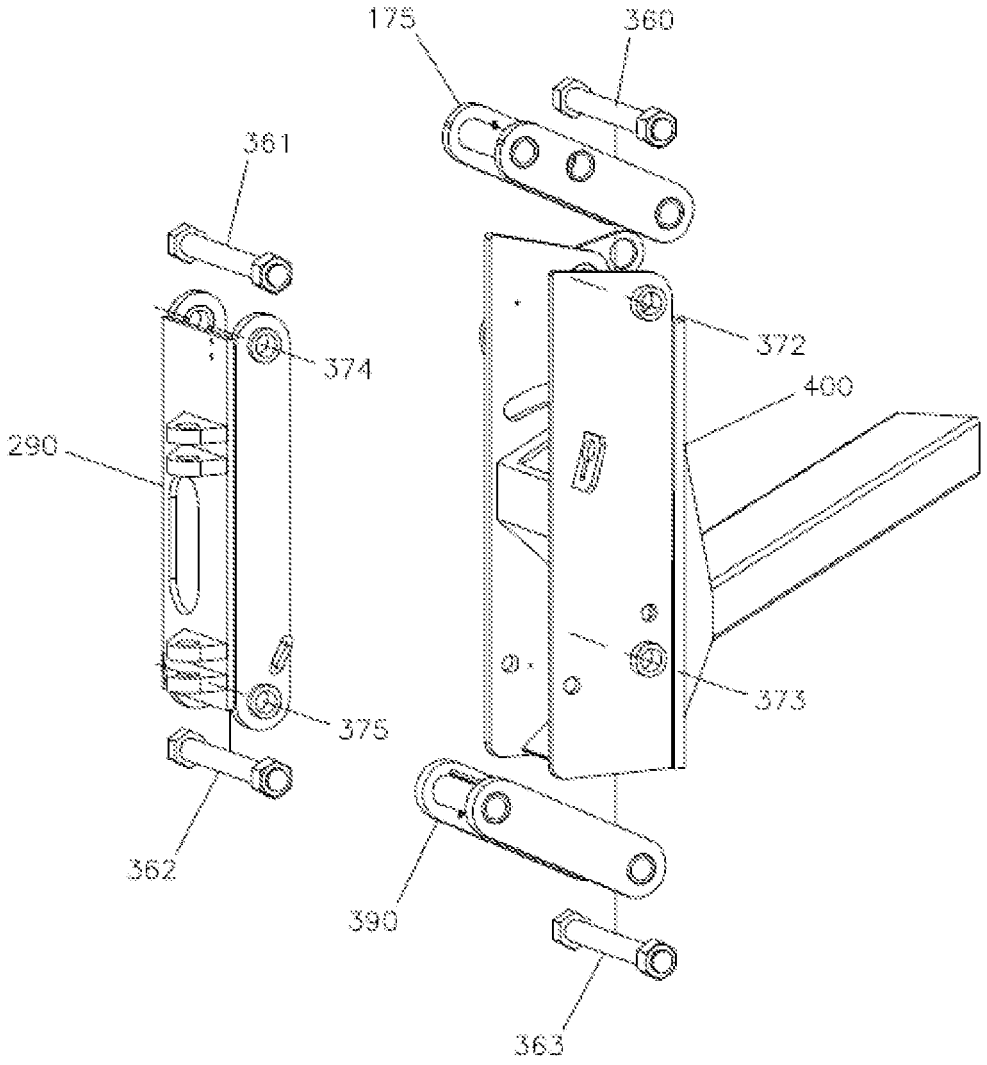
FIG. 11 shows connection bolts of an embodiment of the present invention.

As shown in [FIG. 11] connection bolts 360, 361, 362, and 363 secure the front vertical plate 290 to the upper connection arm 175 and lower connection arm 390. Also, connection bolt 360 attaches the side plates 40, 41 of the upper connection arm 175. Connection bolt 361 attaches the upper connection arm 175 to the front vertical plate 290. Connection bolt 363 attaches the lower connection arm 390 to the mounting assembly 400. Connection bolt 362 attaches the lower connection arm 390 to the front vertical plate 290.

Figure 12:
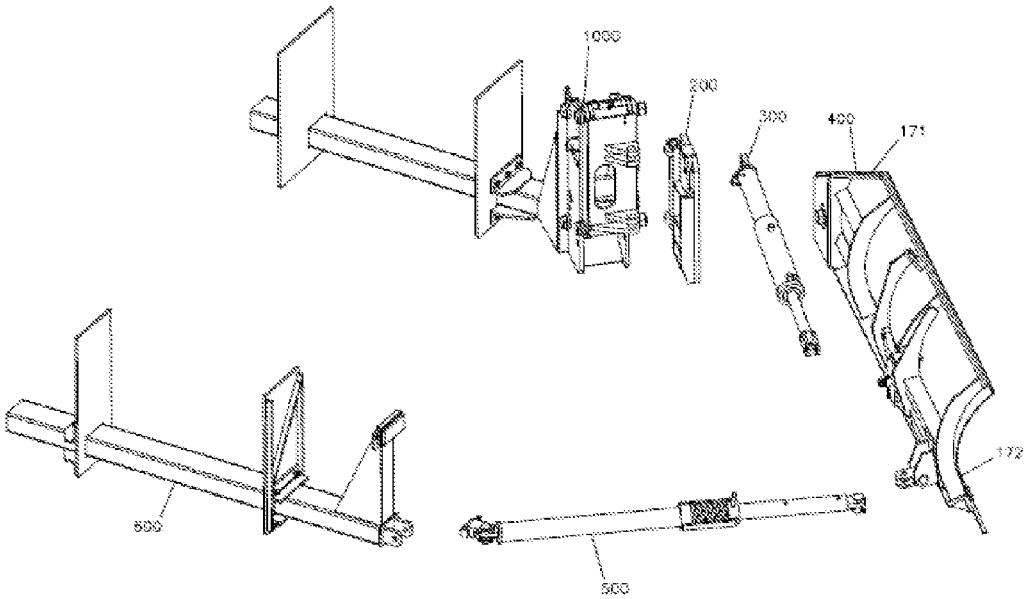
FIG. 12 shows an embodiment of an entire wing plow assembly.
Figure 14:
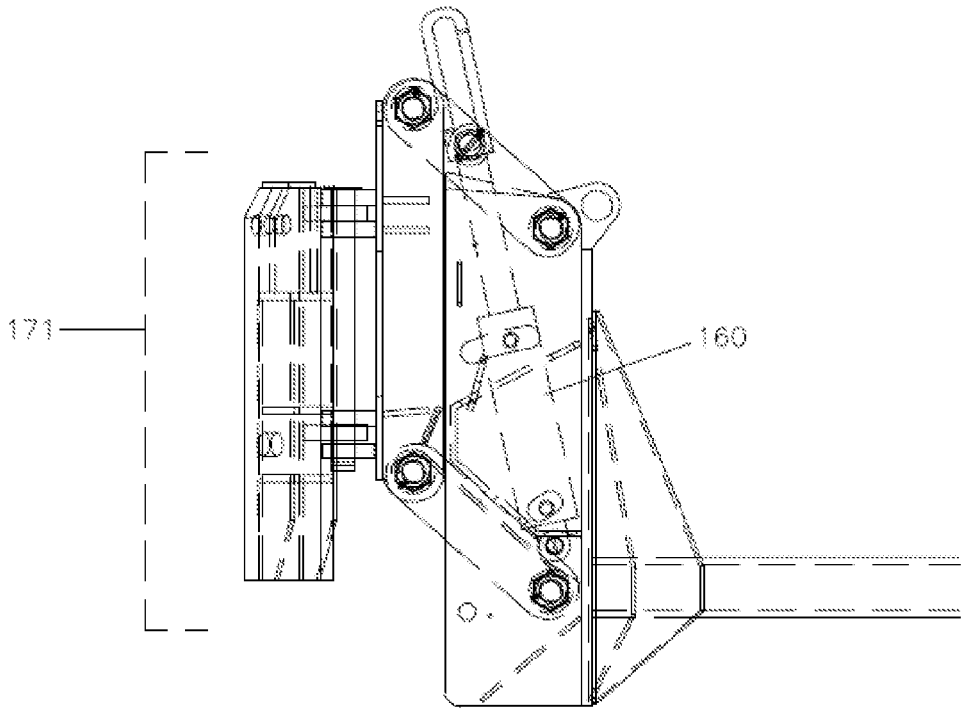
FIG. 14 shows a wing plow post in the upright carrying position of an embodiment of the present invention.
Figure 15:
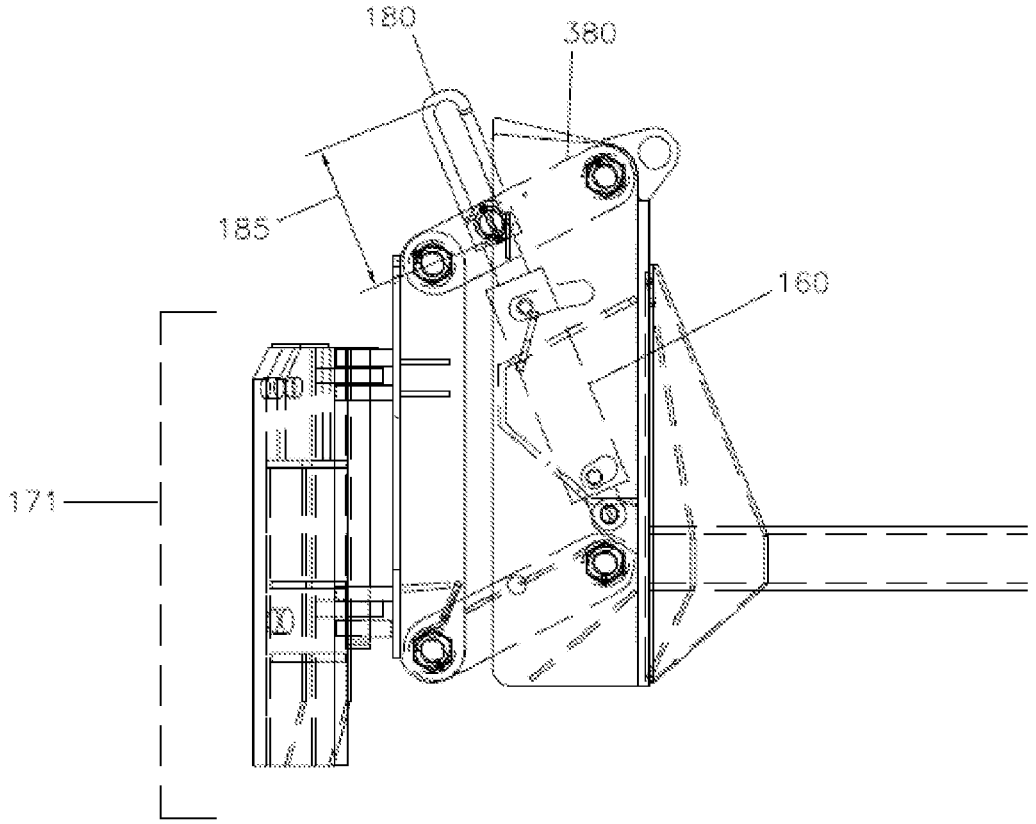
FIG. 15 shows a wing plow post in the operating position of an embodiment of the present invention.
Figure 16:
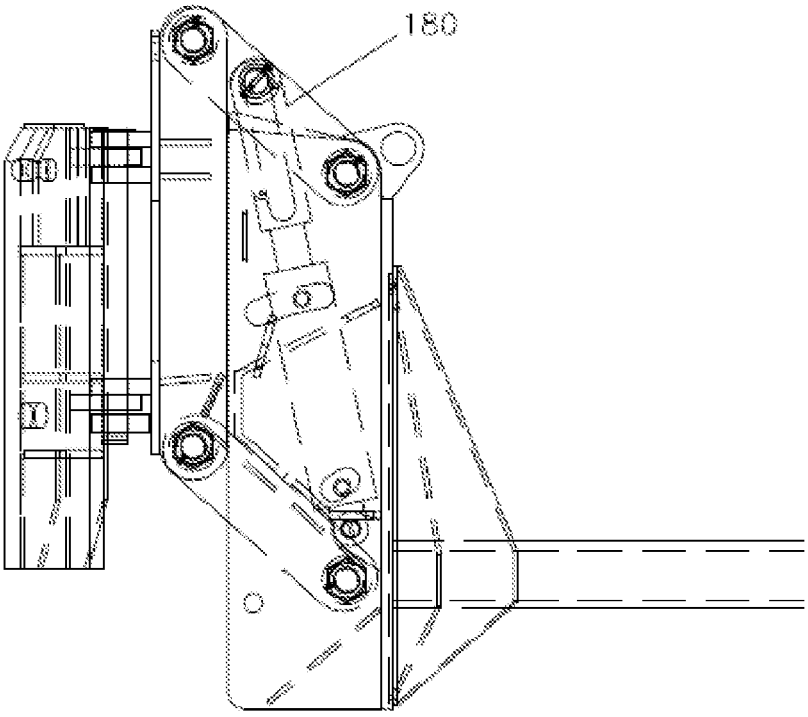
FIG. 16 shows a wing plow post at the top of the float position height of an embodiment of the present invention.
Figure 17:
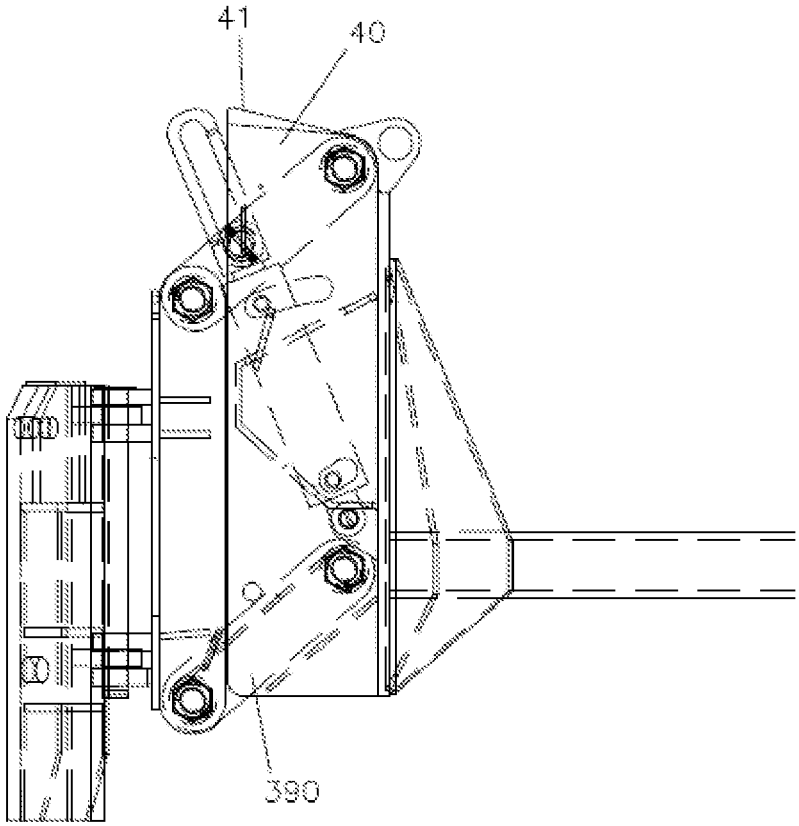
FIG. 17 shows a wing plow post at the lowest position possible of an embodiment of the present invention.

Mounting assembly 1000 [FIG. 12] is connected to a vehicle 700. A hydraulic cylinder 160 lowers the heel end 172 of the wing plow 400. A hydraulic cylinder 160 [FIG. 14] within the mounting assembly moves and lowers the toe end 171 of the wing plow 400 from the storage position and into the operating position [FIG. 15]. The upper connection arm 175 pivots [FIG. 11] on Axis A 372 and lowers the front vertical plate 290 assembly on Axis C 374, thus engaging the wing plow and the surface to be plowed. The lower connection arm 390 moves in accordance to the upper connection arm 175 on Axis B 373 and front vertical plate 290 on Axis D 375. As the vehicle 700 travels the wing plow 400 is able to maintain contact with the surface. The mounting assembly 1000 is shown in typical plowing position [FIG. 15]. The float collar 180 on the hydraulic cylinder 160 is able to provide a specified amount of free travel, or float 185 for the wing plow 400 when in the plowing position. As the driver raises the wing plow 400 back into the storage position the hydraulic cylinder 160 pushes the upper connection arm 175 assembly. The upper connection arm 175 pivots on Axis A 372 and raises the front vertical plate 290 on Axis C 374 and toe end 171 of the wing plow 400. When taking the wing plow 400 from the storage position to the operating position it is common for some designs to stick and stay in the upright storage position. The float collar 180 on the present invention is able to provide down pressure for a set distance and free the assembly [FIG. 16]. Wear to the lower connection arm 390 against the extended side plates 40, 41 on the mounting assembly 1000 is reduced because the extended side plates 40, 41 cover the area of travel by the lower connection arm 390 [FIG. 17].

Various heel supports 600 [FIG. 12] use plates fastened to the vehicle frame, typically with bolts and nuts. Attached to the plates is a tube extending laterally towards the wing plow 400. Such support arrangements attach the heel end of the plow wing 172 to a push beam 500, typically with a spring mechanism to absorb shock caused by the wing plow 400 contacting the roadway. The heel end 172 of the wing plow 400 extends laterally from the side of a vehicle 700 when in the plowing position. The heel end 172 of the wing plow 400 is stored in a semi-upright position next to the vehicle. A hydraulic cylinder 160 is commonly used to raise and lower the heel of the wing plow 400. When the operator engages the wing plow 400, the mounting assembly 1000 folds down to the roadway and extends laterally from the vehicle 700 forming an angle of wing plow in operation 850 from the toe end 171 to the heel 172 end of the wing plow 400 and the vehicle 700 [FIG. 13]. This angle is substantially parallel to the angle of connection link 825 when the wing plow 400 is in the plowing position.

The invention claimed is:

1. A wing plow post assembly comprising:

a tube having an end; a vertical plate secured to the end of the tube, the vertical plate having at least two vertical edges and two hydraulic cylinder connection ears;

two side plates secured to each vertical edge of the vertical plate;

a first end of an upper connection arm pivotally secured to each side plate by bolts, the upper connection arm comprising two side links, two bushings, and a cylinder bushing;

a first end of a lower connection arm pivotally secured to each side plate by bolts, the lower connection arm comprising two side links and two bushings;

the side plates, upper connection arm, and lower connection arm being substantially parallel to a wing plow when the wing plow is mounted to the wing plow post assembly and in its operating position;

a hydraulic cylinder having a lower end and an upper end, the lower end secured to the hydraulic cylinder connection ears and the upper end operably secured to the cylinder bushing;

a front plate pivotally secured to a second end of the upper connection arm and pivotally secured to a second end of the lower connection arm; and a removable slab pin pivotally secured to the front plate.

2. The wing plow post assembly of claim 1 further comprising a float collar secured between the hydraulic cylinder upper end and the cylinder bushing.

3. The wing plow post assembly of claim 1 further comprising a locking collar on each bolt.

4. The wing plow post assembly of claim 1 wherein:

the upper connection arm has a lower edge and the lower connection arm has a lower edge;

the side plates each have a front edge distal the vertical plate and an upper edge between the front edge and vertical plate and a lower edge between the front edge and vertical plate;

the lower edge of the upper connection arm does not extend beyond the upper edge of the side plates proximate the front edge of the side plates; and the lower edge of the lower connection arm does not extend beyond the lower edge of the side plates the front edge of the side plates.

5. The wing plow assembly of claim 1 further comprising an access port in the front plate.

6. A wing plow post assembly comprising:

a vertical plate having at least two vertical edges;

two side plates secured to each vertical edge of the vertical plate;

a first end of an upper connection arm pivotally secured to each side plate by bolts, the upper connection arm comprising two side links and a cylinder bushing;

a first end of a lower connection arm pivotally secured to each side plate by bolts, the lower connection arm comprising two side links;

the side plates, upper connection arm, and lower connection arm being substantially parallel to a wing plow when the wing plow is mounted to the wing plow post assembly and in its operating position;

a hydraulic cylinder having a lower end and an upper end, the lower end secured to the vertical plate and the upper end operably secured to the cylinder bushing;

a front plate pivotally secured to a second end of the upper connection arm and pivotally secured to a second end of the lower connection arm; and a removable slab pin pivotally secured to the front plate.

7. The wing plow post assembly of claim 6 further comprising a float means secured between the hydraulic cylinder upper end and the cylinder bushing.

8. The wing plow post assembly of claim 7 further comprising a locking collar on each bolt.

9. The wing plow post assembly of claim 8 further comprising an access port in the front plate.

10. The wing plow post assembly of claim 6 further comprising an access port in the front plate.

11. The wing plow post assembly of claim 6 wherein:

the upper connection arm has a lower edge and the lower connection arm has a lower edge;

the side plates each have a front edge, an upper edge, and a lower edge;

the lower edge of the upper connection arm does not extend beyond the upper edge of the side plates proximate front edge of the side plates when the front plate and side plates are adjacent; and the lower edge of the lower connection arm does not extend beyond the lower edge of the side plates the front edge of the side plates when the front plate and side plates are adjacent.

* * * * *